US006033115A

United States Patent [19]

Zeiler

[11] Patent Number: 6,033,115

[45] Date of Patent: Mar. 7, 2000

[54] EXPANDABLE RIB STORAGE POUCH

[75] Inventor: George Zeiler, Centerville, Ohio

[73] Assignee: NCR Corporation, Dayton, Ohio

[21] Appl. No.: 09/198,295

[22] Filed: Nov. 23, 1998

[51] Int. Cl.[7] ..... B65D 33/02

[52] U.S. Cl. ..... 383/119; 206/215; 229/67.1; 229/67.4; 229/120.15; 383/38; 383/171; 383/104

[58] Field of Search ..... 229/199, 120.08, 229/120.15, 67.4, 120.13, 67.1; 383/119, 121, 38, 40, 104; 206/193, 170, 171, 174, 175, 215; D9/305, 306, 346

[56] References Cited

U.S. PATENT DOCUMENTS

| | | | |
|---|---|---|---|
| 2,650,016 | 8/1953 | McMillan | 383/121 |
| 3,197,113 | 7/1965 | Griese | 229/199 |
| 3,235,163 | 2/1966 | Hennessey | 229/120.15 |
| 3,288,348 | 11/1966 | Brackett | 229/199 |
| 3,302,847 | 2/1967 | Hennessey | 229/120.08 |
| 3,804,321 | 4/1974 | Forbes, Jr. | 229/120.08 |
| 3,845,898 | 11/1974 | Hackenberg | 229/120.15 |
| 3,946,935 | 3/1976 | Bonczyk | 229/199 |
| 4,757,938 | 7/1988 | Collins | 229/199 |
| 5,850,911 | 12/1998 | Pakzad | 383/38 |

OTHER PUBLICATIONS

Development Dimensions International, copyright MCMXCVI, two–page photograph of file folder.

*Primary Examiner*—Stephen P. Garbe
*Attorney, Agent, or Firm*—Francis L. Conte

[57] ABSTRACT

An expandable storage pouch includes four panels disposed integrally side by side in turn, and a plurality of hinges disposed in a row along a bottom end of a first one of the panels. Each hinge includes a proximal end joined to the first panel, an intermediate rib joined to the proximal end, and a distal end joined to the rib. The rib is severed from the first panel to permit expansion of the pouch, and rigidly separates the first panel from an opposite second panel.

20 Claims, 7 Drawing Sheets

EXPANDABLE RIB STORAGE POUCH

BACKGROUND OF THE INVENTION

The present invention relates generally to stationery products, and, more specifically, to storage pouches.

Pressure sensitive labels in rectangular sheet form are offered for sale in multi-sheet packs such as 25, 50, and 100, for example. The packaging container therefor may vary from a simple envelope type pouch to a two-piece box.

Packaging pouches offer simplicity in structure and manufacturing over boxes, and are more compact, easy to fill with the sheet articles, and therefore reduce cost.

Expandable folders having accordion sides are known for permitting selective increase in thickness of the folder for storing sheets stacked in varying thickness. However, accordion folders lack rigidity and are not desirable as a packaging container for multi-sheet article packs configured for display in a retail stationery establishment.

Accordingly, it is desired to provide an expandable pouch for packaging multi-sheet article packs in a relatively simple configuration initially flat and expandable into a rigid container.

BRIEF SUMMARY OF THE INVENTION

An expandable storage pouch includes four panels disposed integrally side by side in turn, and a plurality of hinges disposed in a row along a bottom end of a first one of the panels. Each hinge includes a proximal end joined to the first panel, an intermediate rib joined to the proximal end, and a distal end joined to the rib. The rib is severed from the first panel to permit expansion of the pouch, and rigidly separates the first panel from an opposite second panel.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
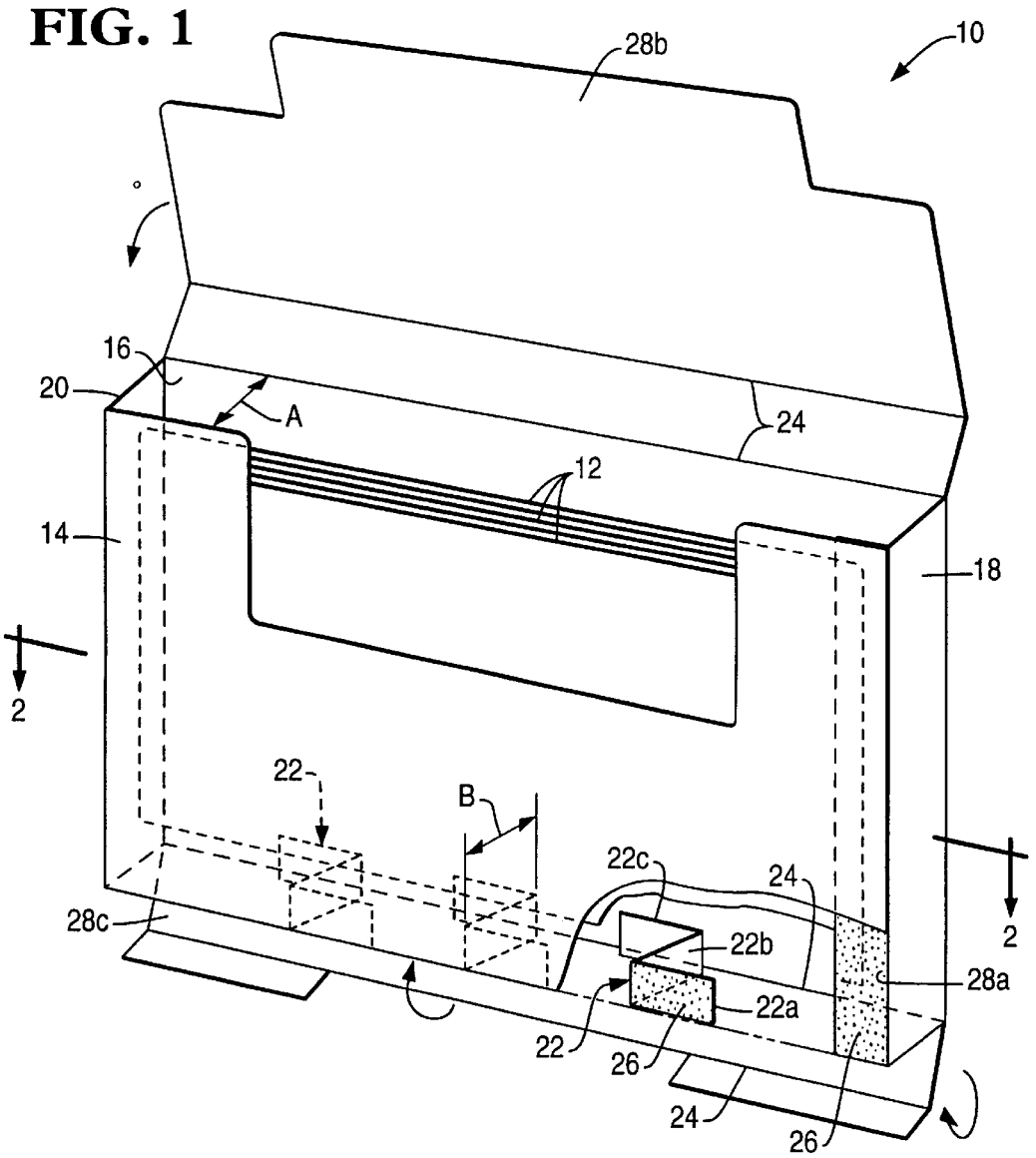
FIG. 1 is an isometric view of an expandable storage pouch having bottom hinges in accordance with an exemplary embodiment of the present invention.

Illustrated open in FIG. 1 is an expandable packaging or storage pouch 10 in accordance with an exemplary embodiment of the present invention. The pouch is expandable to a narrow rectangular box form for storing therein one or more articles 12 in the exemplary form of pressure sensitive label sheets having a standard rectangular configuration of 8.5×11 inch (22×28 cm) for example. The sheet articles are individually thin but when packed in groups of 50 or 100 for example, have a collective thickness requiring a corresponding internal thickness or width A of the pouch.

In the exemplary embodiment illustrated in FIG. 1, the pouch includes four flat and generally rectangular panels 14,16,18,20 disposed integrally side by side in turn in a unitary assembly expandable to a rectangular box configuration. A plurality of hinges 22 are disposed in a row along a bottom end of the first panel 14 for providing expansion capability of the pouch from an initially folded and flat form to an expanded box configuration, with the hinges also providing a bottom support for the articles 12 resting thereatop.

Figure 2:
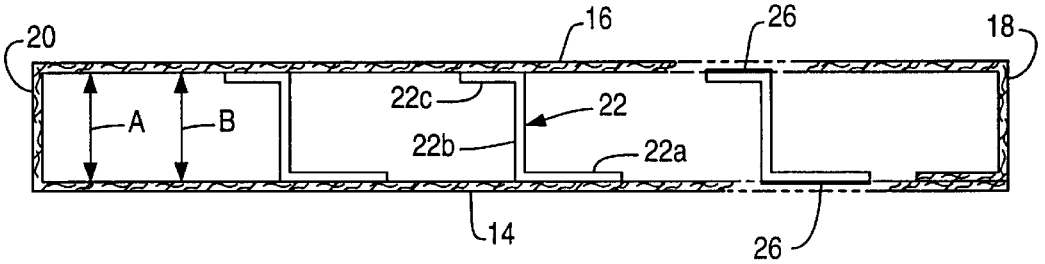
FIG. 2 is a sectional view through the bottom of the pouch illustrated in FIG. 1 and taken along line 2—2 to illustrate a plurality of hinges therein in accordance with one embodiment of the present invention.

The hinges 22 are additionally shown in FIG. 2, and each includes a proximal end 22*a* integrally joined to the first panel 14. An intermediate leg or rib 22*b* of each hinge is integrally joined to a respective proximal end thereof, and is severed or die cut from the first panel 14. A distal end 22*c* of each hinge is integrally joined to the corresponding rib 22*b* and is configured to adjoin a corresponding bottom end of the second panel 16 which is disposed generally opposite and parallel to the first panel 14.

The first and second panels 14,16 may define front and back panels of the pouch as desired, and may include suitable graphics and printing thereon for identifying the articles stored in the pouch. The third and fourth panels 18,20 define side panels integrally joined to the first and second panels, and may also contain printing as desired. The side panels preferably have the same or common width A, and control the resulting width of the expanded pouch.

Correspondingly, each of the hinge ribs 22*b* has the same or common length B which is equal to the width A of the side panels for bridging and supporting the first and second panels 14,16 at the bottom ends thereof. The side panels are preferably narrower than the first and second panels to provide a pouch having a suitable thickness for packaging a desired number of the sheet articles 12 therein.

The pouch may be formed of any suitable material such as plastic or heavyweight paper, with the several panels being flat and rectangular. The side panels are relatively rigid along their widths for providing structural rigidity to the sides of the pouch, and the hinge ribs 22*b* provide structural rigidity at the bottom of the pouch. The top of the pouch is open for receiving and dispensing the articles therethrough as desired.

Figure 3:
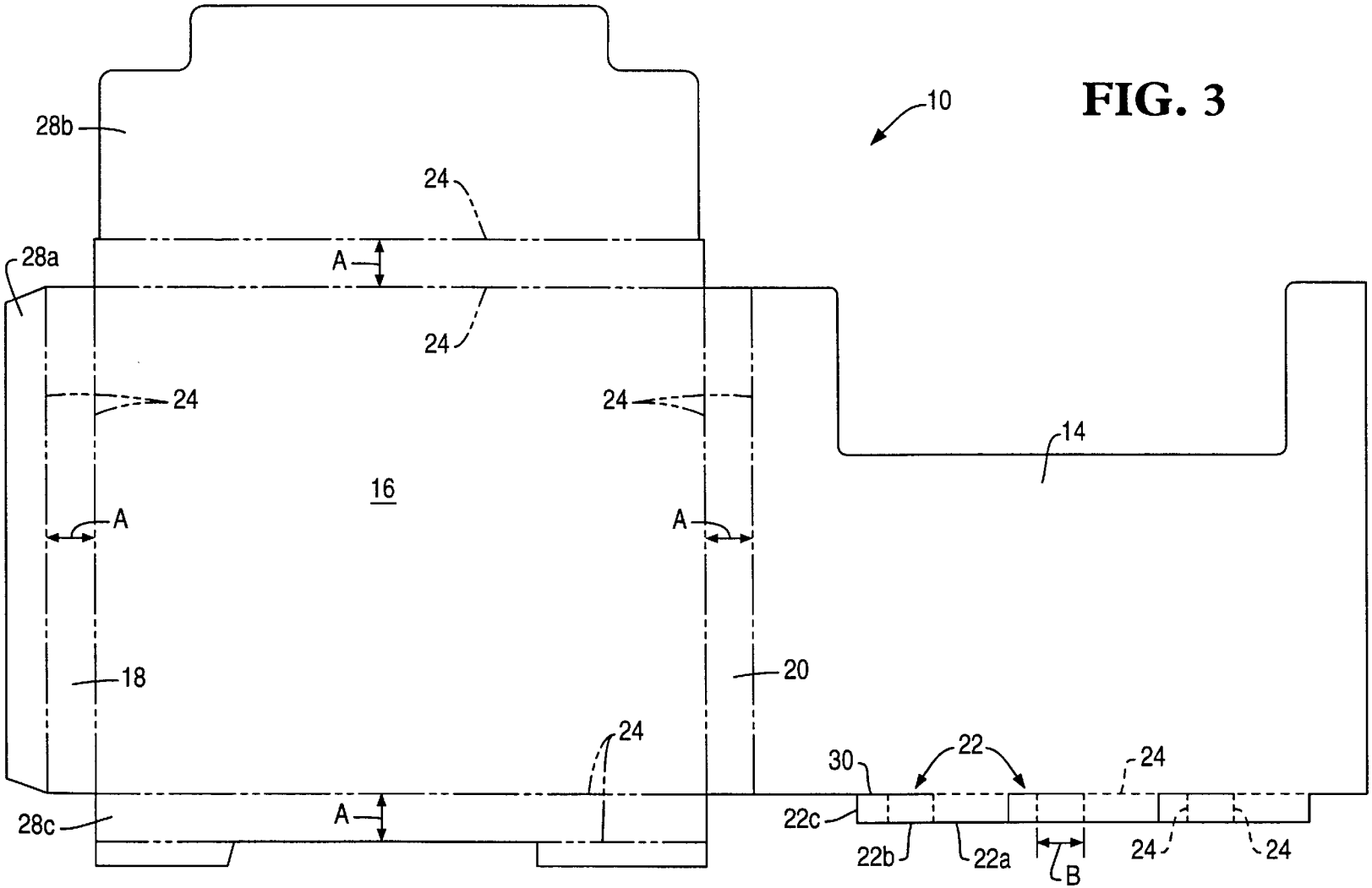
FIG. 3 is a plan view of the pouch illustrated in FIG. 1 in initial flat form prior to folding and assembly thereof.

As shown in FIGS. 1 and 3, the ribs 22*b* are preferably rectangular in configuration and extend parallel or horizontal to the bottom ends of the first and second panels 14,16.

As shown in FIG. 3, the pouch 10 may be initially formed from a single, unitary sheet of material with a corresponding die cut outer profile which allows folding of the different portions to effect the resulting rectangular box illustrated in FIG. 1. Accordingly, the pouch includes various fold lines 24, shown in phantom line in FIG. 3, at suitable locations for allowing the pouch to be folded or bent into its final configuration, with the fold lines then defining corresponding corners or edges thereof. The fold lines 24 are conventional in configuration and are formed by scoring or indenting the pouch material along the required lines. The initial pouch is flat, but is readily bent into three dimensional configuration by folding along the corresponding lines.

As shown in FIG. 3, the hinges 22 are preferably integrally formed in the initial pouch sheet, with each of the corresponding ribs 22*b* being defined between a pair of vertical fold lines 24 for permitting bending therealong between the proximal and distal ends 22*a,c*.

The rectangular ribs 22*b* are parallel to each other in a single line as illustrated in FIG. 3, and are also parallel to the side panels 18,20 when assembled and expanded as shown in FIG. 2.

During the assembly process, an adhesive 26 is disposed on the hinge distal ends 22*c* for fixedly bonding the distal ends to the second panel 16, with the hinge proximal ends 22*a* being fixedly joined to the first panel 14 at their corresponding fold lines.

As shown in FIG. 2, the first and second panels 14,16 in the assembled pouch are parallel to each other, with the ribs 22*b* extending obliquely therebetween, and preferably perpendicular, for maximizing the structural rigidity at the bottom end of the pouch between the opposite first and second panels 14,16.

Figure 4:
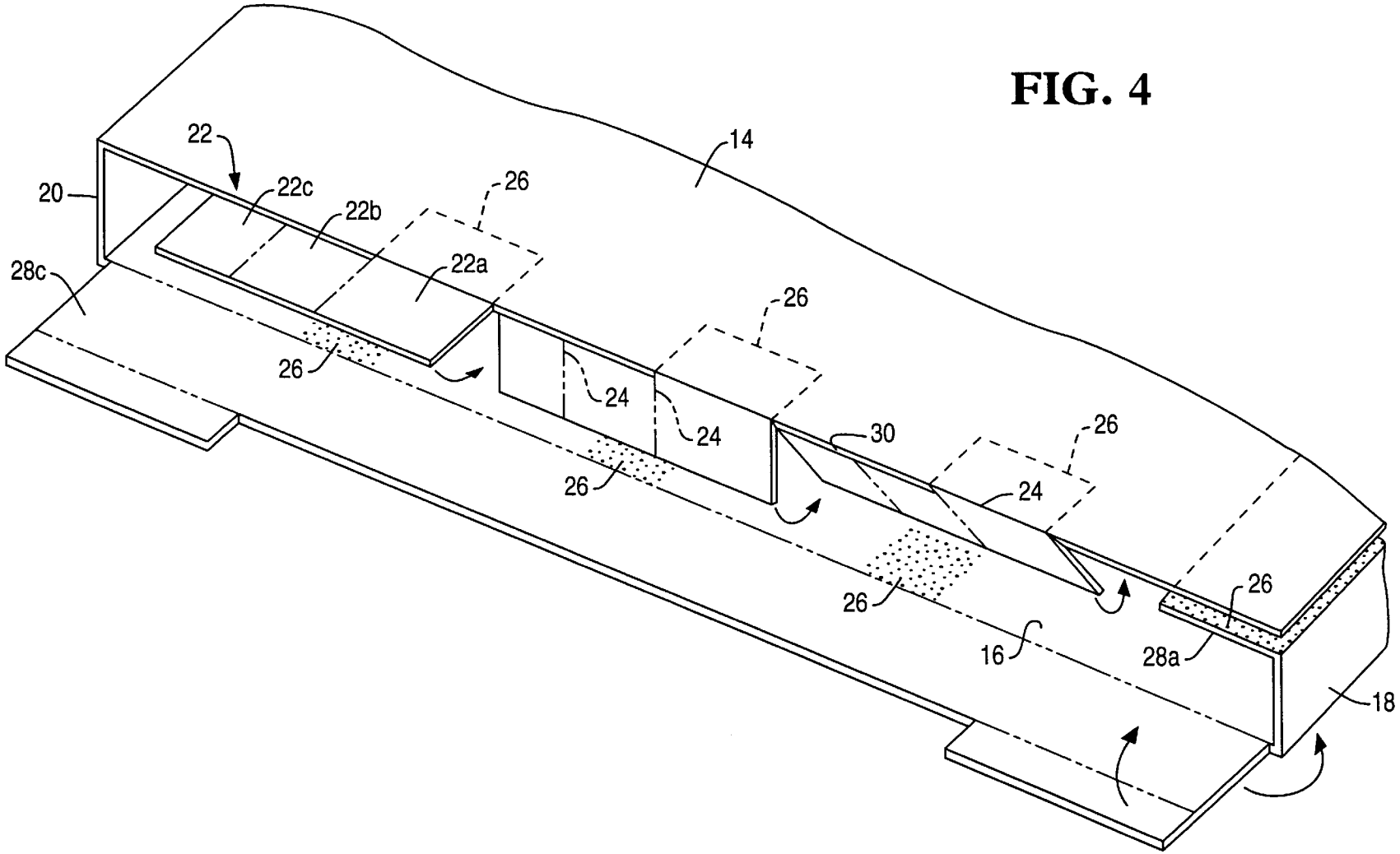
FIG. 4 is an isometric view of the bottom end of the pouch illustrated in FIG. 1 being folded and assembled.

FIG. 4 illustrates assembly of the initially flat pouch 10 illustrated in FIG. 3 by folding along the respective fold lines to position the first and second panels 14,16 opposite to each other, and the side panels 18,20 opposite to each other in a generally rectangular configuration. The third panel 18 preferably includes an integral side flap 28*a* having the adhesive 26 thereon for fixedly bonding the side panel 18 along a corresponding edge of the first panel 14. The respective hinge distal ends 22*c* are adhesively bonded to the inner surface of the second panel 16 and complete the bridges therebetween.

Figure 5:
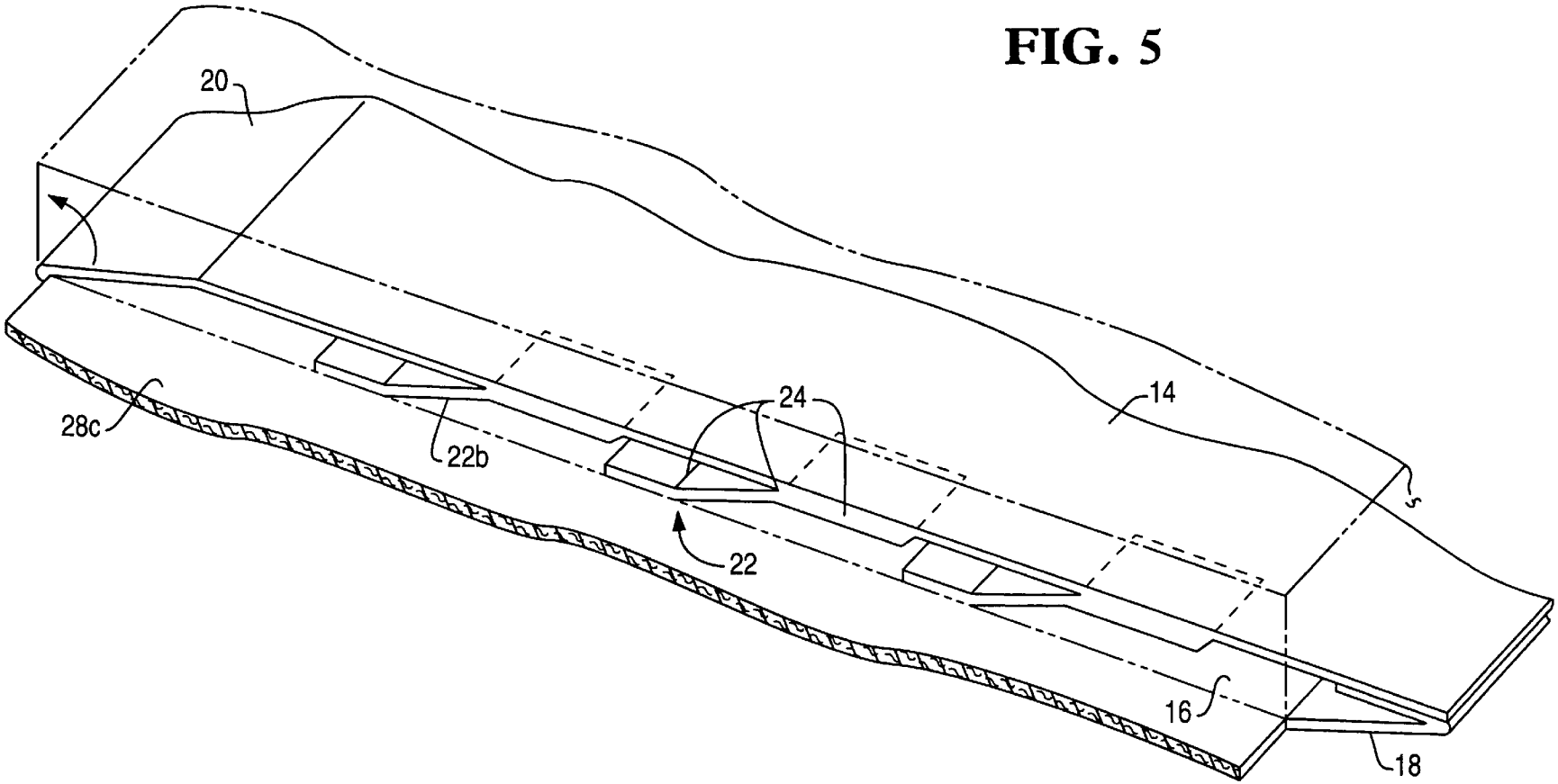
FIG. 5 is an isometric view like FIG. 4 of the assembled pouch being expanded at the hinges for receiving a pack of articles therein.

As shown in FIG. 5, the ribs 22*b* are positionable at a collapsed position generally coplanar with both the first and second panels 14,16 when the two panels are folded flat against each other. And, the ribs 22*b* are also positionable to an expanded position, shown in phantom in FIG. 5 and in solid line in FIG. 2, extending perpendicularly between the first and second panels 14,16.

The respective hinges 22 are therefore Z-shaped in their expanded position, with the proximal ends 22*a* being fixedly joined to the first panel 14, and the distal ends 22*c* being fixedly joined to the opposite second panel 16. The hinges therefore allow the assembled pouch to remain substantially flat after initial assembly, with the hinges being collapsed for providing a compact and flat configuration of the pouch for its own storage in corresponding boxes therefor.

The individual collapsed pouches may then be expanded for use by simply tilting the hinges 22 and side panels by skewing the pouch to provide a rectangular internal pocket within the pouch in which the articles 12 may be inserted as shown in FIG. 1. The hinge ribs 22*b* bridge the two panels 14,16 along the bottom ends thereof to provide structural integrity in the expanded box-pouch 10, and also vertically support the articles 12 resting thereatop.

As also shown in FIG. 1, the pouch may also include a top flap 28*b* extending integrally outwardly from the top of the second panel 16 and configured with a pair of the fold lines 24 for closing the top of the pouch to secure the articles therein. The top flap 28*b* may have any conventional configuration, and may join the first panel 14 using a suitable adhesive, or friction overlap therewith as desired.

Furthermore, the pouch 10 illustrated in FIG. 1 may also include a bottom flap 28*c* extending integrally outwardly from the bottom of the second panel 16, and similarly has a pair of the fold lines 24 for closing the bottom of the pouch and covering the hinges 22 disposed therein. The bottom flap is optional and may be joined to the first panel 14 by corresponding tabs or adhesive as desired. The resulting pouch 10 illustrated in FIG. 1 is a unitary or one-piece assembly of components formed from a single sheet of material readily assembled with simple adhesive 26 at the side flap 28*a* and at the respective hinges 22.

In the preferred embodiment illustrated in FIGS. 3 and 4, the hinges 22 are discrete components which are readily die cut at the bottom of the first panel 14. The ribs 22*b* and distal ends 22*d* are separated from the first panel 14 by corresponding die cuts 30, with the proximal ends 22*a* remaining integrally attached to the first panel 14 at the corresponding fold lines 24. The hinge distal ends 22*c* are separated from each other and individually adhesively bonded to the inner surface of the opposite second panel 16 as illustrated in FIG. 4.

The corresponding fold lines 24 joining the hinge proximal ends 22*a* to the first panel 14 provide an integral joint therewith and permit the initially flat hinges to be reverse bent 180E about the fold lines, and adhesively bonded to the inner surface of the first panel 14.

Correspondingly, each of the hinge distal ends 22*c* is adhesively bonded to the inner surface of the opposite second panel 16 as shown in FIG. 5. The resulting hinges 22 are therefore flush with the bottom ends of the first and second panels 14,16 as well as the bottom ends of the side panels 18,20. And, the fold lines 24 at the opposite ends of the ribs 22*b* allow the pouch to remain collapsed, yet readily permit expansion of the pouch by pivoting thereat to position the ribs perpendicularly between the opposite panels as illustrated in FIGS. 1 and 2.

The resulting pouch 10 illustrated in FIGS. 1–5 is relatively simple in construction, readily assembled using the adhesive 26 solely at the side flap 28*a* and the hinges, and is readily expandable for providing a suitable interior pocket for packaging one or more of the articles therein. The hinges provide structural rigidity for the bottom of the pouch comparable to that provided by the relatively rigid side panels 18,20.

Figure 6:
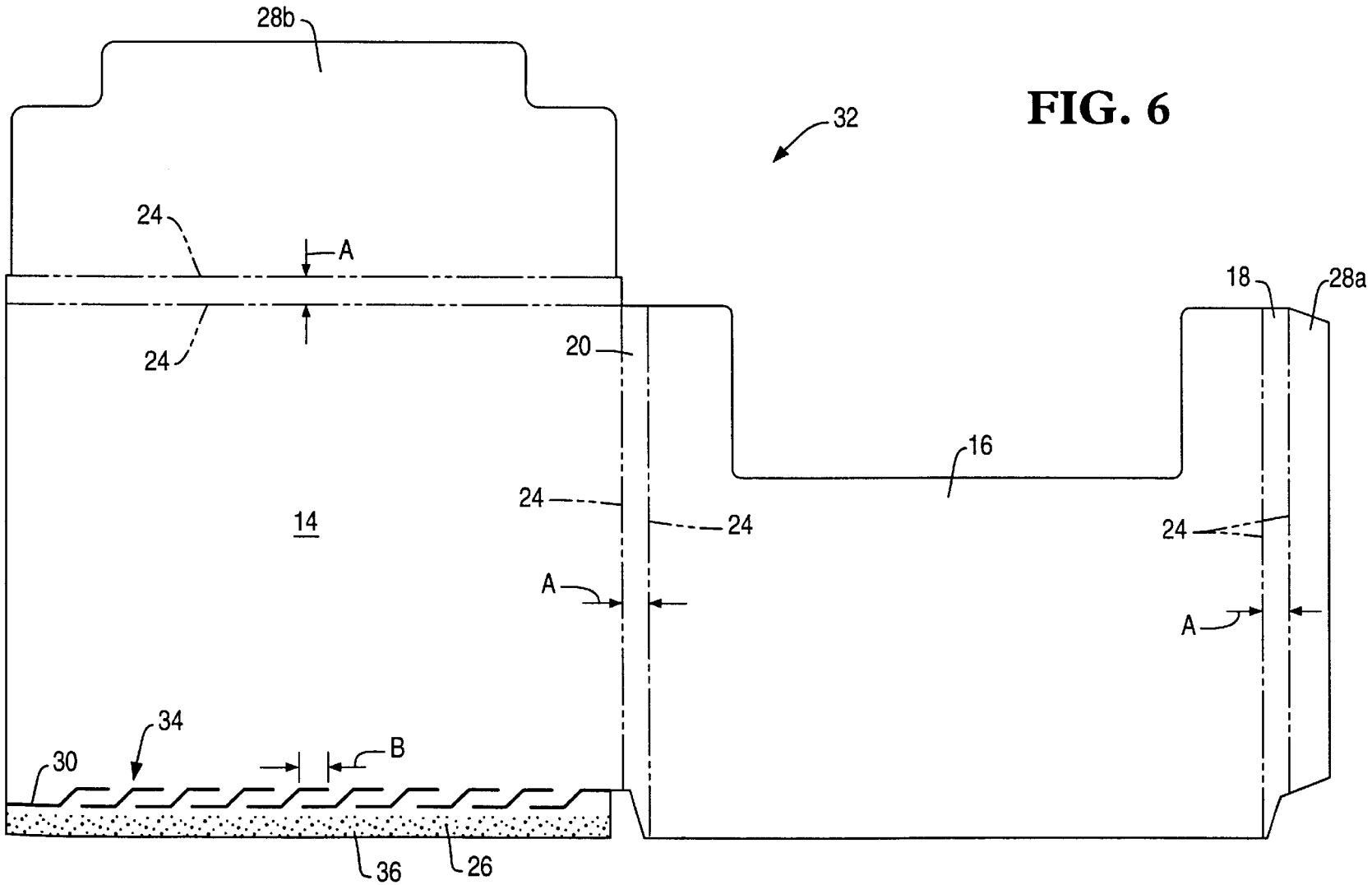
FIG. 6 is a plan view like FIG. 3 of the expandable pouch with expansion hinges in accordance with another embodiment of the present invention.
Figure 7:
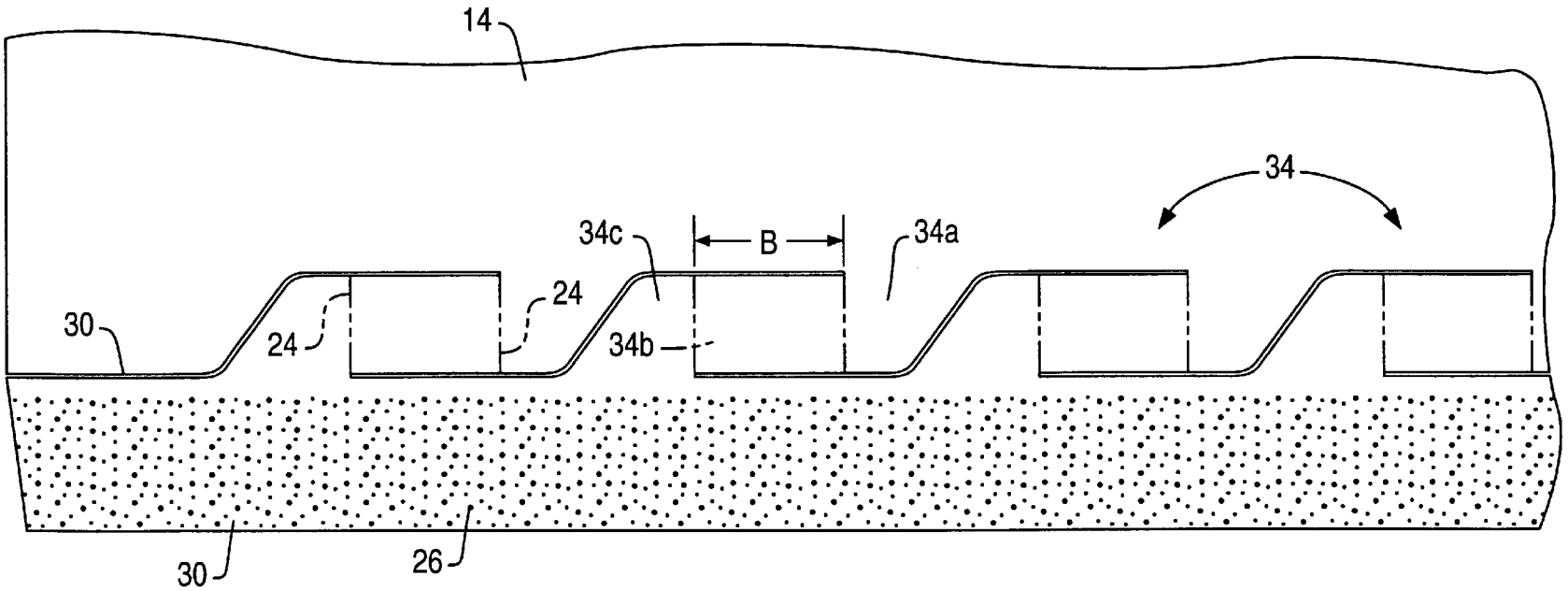
FIG. 7 is an enlarged view of a portion of the hinges illustrated in FIG. 6.
Figure 8:
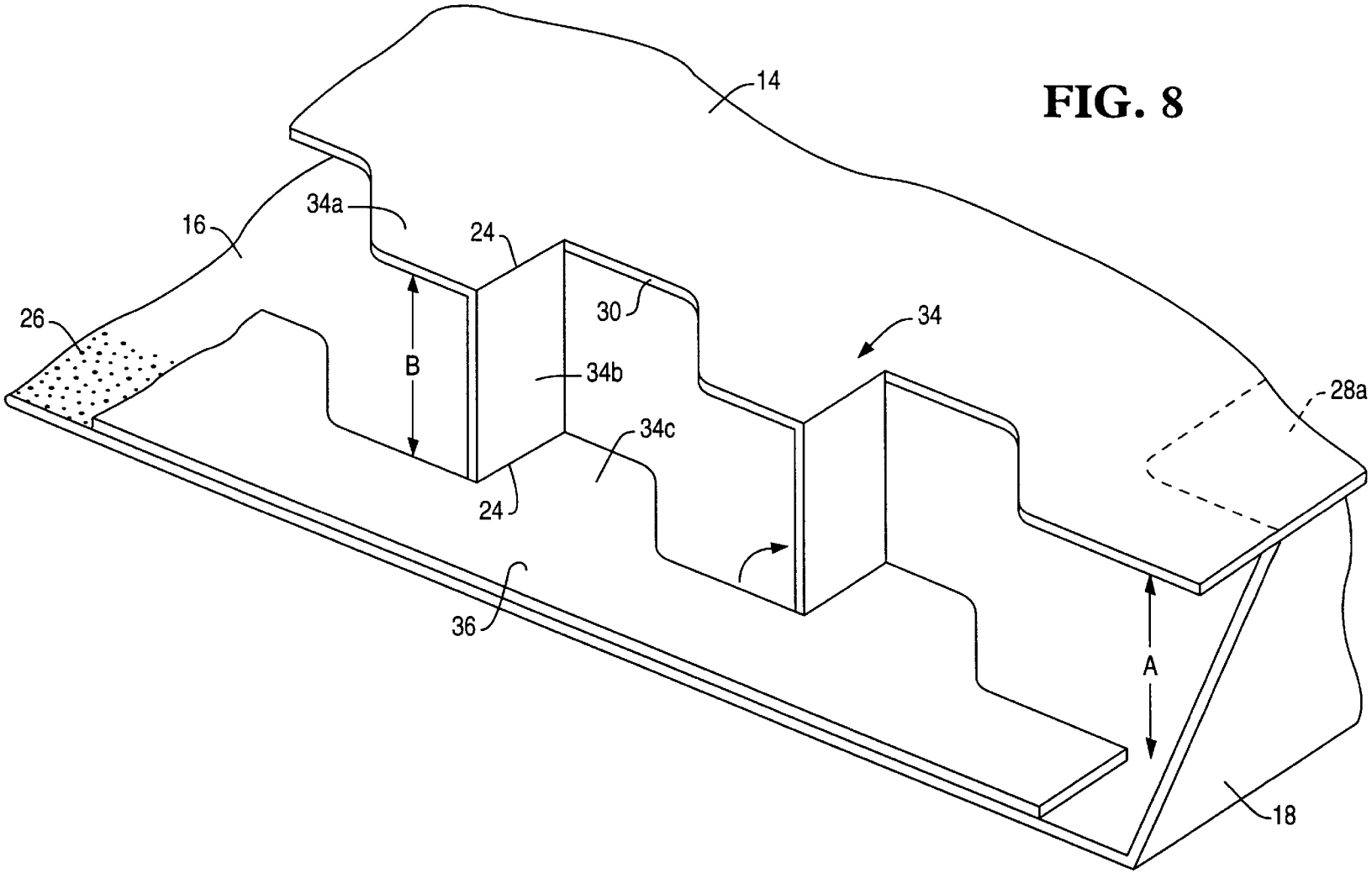
FIG. 8 is an isometric view of a bottom portion of the assembled pouch illustrated in FIG. 6 with the hinges deployed for expanding the pouch.

FIGS. 6–8 illustrate a pouch, designated 32, in accordance with another embodiment of the present invention which is similar to the first embodiment, but with a modified form of the hinges, designated 34. Since the hinges in either embodiment may be defined in either of the first and second panels 14,16, which correspondingly may define either front or back sides of the resulting pouch as desired, the location of the first and second panels 14,16 in the second embodiment is reversed from that illustrated in the first embodiment, with the modified hinges 34 being disposed at the bottom of the first panel 14. Note that similar reference numerals are used for similar components in the two embodiments.

Like the first hinges 22 illustrated in the first embodiment, the corresponding hinges 34 also include a respective proximal end 34*a* integrally formed with the first panel 14, a rib 34*b* severed from the first panel by a die cut 30 and integrally joined to the proximal end 34*a*by a fold line 24, and a distal end 34*c* also severed from the first panel by a continuation of the die cut 30, and integrally joined to the rib 34*b* by a corresponding fold line 24.

In this embodiment, the hinges 34 are integrated together, and the distal ends 34*c* are joined together by being integrally joined to a common border 36. The hinges and border are initially part of the first panel 14 and are distinguished therefrom by the corresponding die cuts 30 having the general S-shape illustrated initially in FIGS. 6 and 7. The common border 36 is adhesively bonded to the inner surface of the opposing second panel 16 at the bottom end thereof using the adhesive 26 during the assembly process.

As best shown in FIG. 8, each of the hinge proximal ends 34*a* is uninterrupted without fold line at the first panel 14 and is coextensive therewith. Due to the S-profile of the die cuts 30, the proximal ends 34*a* are correspondingly tapered in ramp configurations. The proximal ends 34*a* at all times remain coplanar with the first panel 14 both in the collapsed and expanded positions.

Correspondingly, the hinge distal ends 34*c* as illustrated in FIG. 8 remain at all times coplanar with the border 36 bonded atop the second panel 16, and are similarly tapered like the proximal ends 34*a* in a ramp profile. The ribs 34*b* are preferably rectangular and extend from their collapsed position sandwiched between the first and second panels 14,16 to their expanded position perpendicular between the two panels as illustrated in FIG. 8.

In this embodiment, the hinge proximal ends 34*a* are not folded under the first panel 14 but remain extended and coplanar therewith. Accordingly, the hinges 34 are correspondingly vertical offset between the bottom ends of the first and second panels 14,16. The common border 36 is bonded to the bottom end of the second panel 16, with the hinges 34 extending inboard or upwardly away from the border 36 to position the hinges along the bottom edge of the first panel 14. The hinges 34 are therefore visible from the first panel 14, but not visible from the second panel 16. The second panel 16 may therefore be configured as a front panel of the pouch, with the first panel 14 being configured as the back of the pouch for hiding from view the exposed hinges 34.

In both embodiments disclosed above, the corresponding ribs extend perpendicularly between the first and second panels 14,16 and provide structural rigidity at the bottom of the pouch for maintaining the box configuration thereof, while also providing a support upon which the articles 12 are rested.

The expandable pouches disclosed above are simple in construction, with each starting as a unitary single sheet of material having an outer profile cut to shape, with the integral hinges being identified by corresponding die cuts and fold lines. In this form, the pouches may be shipped and stored flat in bulk.

Assembly of the pouches is easily accomplished by simply folding about the respective fold lines and selectively applying the adhesive to secure the panels together, and securing the hinges to the opposing panel. The so assembled pouches may still remain flat in their collapsed position for decreasing bulk during storage. When required, the pouches may then be easily expanded to position the corresponding ribs perpendicularly between the opposing panels, with the pouches then being filled with one or more of the articles. The top flap, and the optional bottom flap if used, may then be closed, with the filled packages then being available for purchase by consumers.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim:

1. An expandable storage pouch comprising:

four panels disposed integrally side by side in turn;

a plurality of hinges disposed in a row along a bottom end of a first one of said panels; and each hinge having a proximal end integrally joined to said first panel, an intermediate rib integrally joined to said proximal end and severed from said first panel, and a distal end integrally joined to said rib and configured to adjoin a second one of said panels.

2. A pouch according to claim 1 wherein third and fourth ones of said four panels define side panels integrally joined to said first and second panels, and each having a width equal to a length of said ribs for bridging said first and second panels at said bottom ends thereof.

3. A pouch according to claim 2 wherein said ribs extend parallel to said bottom ends of said first and second panels.

4. A pouch according to claim 3 wherein said ribs are rectangular.

5. A pouch according to claim 4 wherein each of said ribs is defined between a pair of fold lines for permitting bending therealong between said proximal and distal ends.

6. A pouch according to claim 5 wherein said ribs are parallel to each other and to said side panels.

7. A pouch according to claim 6 further comprising an adhesive disposed on said hinge distal ends for bonding said distal ends to said second panel.

8. A pouch according to claim 7 wherein said first and second panels are parallel to each, with said ribs extending obliquely therebetween.

9. A pouch according to claim 8 wherein said ribs are positionable between a collapsed position generally coplanar with said first panel, and an expanded position extending perpendicularly between said first and second panels.

10. A pouch according to claim 9 wherein said hinges are Z-shaped in said expanded position.

11. A pouch according to claim 9 wherein said hinges are discrete, and said distal ends thereof are separated from each other.

12. A pouch according to claim 11 wherein each of said hinge proximal ends includes a fold line at said first panel.

13. A pouch according to claim 12 wherein each of said hinge proximal ends is reverse bent about said fold line thereat, and adhesively bonded to said first panel.

14. A pouch according to claim 13 wherein each of said hinge distal ends is adhesively bonded to said second panel.

15. A pouch according to claim 14 wherein said hinges are flush with said bottom ends of said first and second panels.

16. A pouch according to claim 9 wherein said hinges are integrated, and said distal ends thereof are joined together.

17. A pouch according to claim 16 wherein each of said hinge proximal ends is uninterrupted at said first panel.

18. A pouch according to claim 17 wherein each of said hinge proximal ends is coplanar with said first panel.

19. A pouch according to claim 18 wherein said hinge distal ends are integrally joined to a common border, and said border is adhesively bonded to said second panel.

20. A pouch according to claim 19 wherein said hinges are offset between said bottom ends of said first and second panels.

* * * * *